US009798279B2

(12) United States Patent
Jensen et al.

(10) Patent No.: US 9,798,279 B2
(45) Date of Patent: Oct. 24, 2017

(54) PRINTED THERMOCOUPLES IN SOLID HEATER DEVICES

(71) Applicant: Xerox Corporation, Norwalk, CT (US)

(72) Inventors: Christopher A. Jensen, Portland, OR (US); Brian J. Gillis, Penfield, NY (US); Tab A. Tress, Henrietta, NY (US); Michael A. Fayette, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/789,579

(22) Filed: Jul. 1, 2015

(65) Prior Publication Data

US 2017/0003632 A1 Jan. 5, 2017

(51) Int. Cl.
*G03G 15/20* (2006.01)

(52) U.S. Cl.
CPC . *G03G 15/2053* (2013.01); *G03G 2215/0167* (2013.01)

(58) Field of Classification Search
CPC ..... G03G 15/2053; G03G 15/2017
USPC ..... 399/69, 122, 329, 333
See application file for complete search history.

(56) References Cited

U.S. PATENT DOCUMENTS 4,565,439 A 1/1986 Reynolds
5,068,517 A 11/1991 Tsuyuki et al.
5,525,775 A 6/1996 Setoriyama et al.
5,732,318 A * 3/1998 Natsuhara ..... G03G 15/2064 219/216
6,336,009 B1 1/2002 Suzumi et al.
6,734,397 B2 5/2004 Kato et al.
6,870,140 B2 3/2005 Cook et al.
7,623,819 B2 11/2009 Tress
7,970,316 B2 6/2011 Cao et al.
8,036,545 B2 * 10/2011 Kanno ..... G03G 15/2039 399/122
8,669,495 B2 3/2014 Makihira et al.
2005/0002054 A1 * 1/2005 Shoji ..... G06F 3/1204 358/1.14
2005/0257822 A1 * 11/2005 Smith ..... G01K 7/02 136/205

(Continued)

FOREIGN PATENT DOCUMENTS

DE 10 2012 018 387 A1 3/2014

OTHER PUBLICATIONS

Horowitz, Paul and Hill, Winfields, "The Art of Electronics" Second Edition, 1989, Cambridge University Press, p. 988-989.*

*Primary Examiner* — Benjamin Schmitt
(74) *Attorney, Agent, or Firm* — Gibb & Riley, LLC

(57) ABSTRACT

A fuser heater within a printing device includes a substrate with conductive traces and a resistive trace having a first end and a second end. The resistive trace is connected to the conductive traces at each of the first end and the second end and forms an electrical connection between the conductive traces and the resistive trace. A first strip is printed on the substrate using a first metal ink. A second strip is printed on the substrate using a second metal ink. The second strip is in contact with the first strip. The first metal ink is different from the second metal ink. The first strip and the second strip form a thermocouple. The thermocouple is operatively attached to the conductive traces. A controller operatively attached to the thermocouple controls the temperature of the fuser heater.

14 Claims, 3 Drawing Sheets

FIG. 3B

(56) References Cited

U.S. PATENT DOCUMENTS

| | | | | |
|---|---|---|---|---|
| 2008/0240748 | A1* | 10/2008 | Kinouchi | G03G 15/2039 399/33 |
| 2011/0277803 | A1 | 11/2011 | Grande et al. | |
| 2012/0051807 | A1 | 3/2012 | Tress et al. | |
| 2012/0135686 | A1* | 5/2012 | Yang | H04M 1/6066 455/41.2 |
| 2014/0050497 | A1* | 2/2014 | Jensen | G03G 15/2042 399/67 |

* cited by examiner

PRINTED THERMOCOUPLES IN SOLID HEATER DEVICES

BACKGROUND

Devices and methods herein generally relate to machines such as printers and/or copier devices and, more particularly, to heater elements in the device.

In electrostatographic printing, commonly known as xerographic or printing or copying, an important process step is known as "fusing". In the fusing step of the xerographic process, dry marking material, such as toner, that has been placed in imagewise fashion on an imaging substrate, such as a sheet of paper, is subjected to heat and/or pressure in order to melt, or otherwise fuse the toner permanently on the substrate. In this way, durable, non-smudging images are rendered on the substrate.

Currently fusers utilizing solid heaters measure temperature of the control elements using thermistors. These thermistors cost money, take up space, and only measure temperature accurately at a narrow range around the control space.

SUMMARY

Solid heaters for fusing are formed through screen-printing resistive ink traces into a glass substrate. Additional traces can be added to the mask and dissimilar metals put in those traces to form a thermocouple directly in the heater. This thermocouple junction would be placed in close proximity to the resistive trace either in the same plane or a separate plane above/below. The temperature feedback from the thermocouple would then be used to control power across the resistive trace and thus fusing temperature.

According to a fuser heater within a printing device, the heater comprises a substrate and conductive traces attached to the substrate. A resistive trace is attached to the substrate and connected to the conductive traces, forming an electrical connection between the conductive traces and the resistive trace. A first strip is printed on the substrate using a first metal ink. A second strip is printed on the substrate using a second metal ink. The second strip is in contact with the first strip. The first metal ink is different from the second metal ink. The first strip and the second strip form a thermocouple. The thermocouple is operatively attached to the conductive traces. A controller is operatively attached to the thermocouple and controls the temperature of the fuser heater.

According to a machine herein, the machine comprises an imaging apparatus recording an image, a transfer device transferring the image onto a copy sheet, and a fuser. The fuser comprises a fuser belt and a pressure roll. The fuser belt and pressure roll form a nip therebetween through which the copy sheet is conveyed, permanently fusing the image onto the copy sheet. The fuser includes a heater inside the fuser belt. The heater comprises a conductive trace, a resistive trace electrically connected to the conductive trace, a substrate, a first strip printed on the substrate using a first metal ink, and a second strip printed on the substrate using a second metal ink. The first metal ink is different from the second metal ink. The first strip is in contact with the second strip forming a thermocouple. A controller controls the temperature of the fuser belt. The conductive trace is operatively attached to the controller. The thermocouple is operatively attached to the controller.

According to a printer herein, an imaging apparatus records an image. A transfer device transfers the image onto a copy sheet. The printer includes a fuser comprising a fuser belt and a pressure roll. The fuser belt and pressure roll form a nip therebetween through which the copy sheet is conveyed, permanently fusing the image onto the copy sheet. The fuser belt includes a heater comprising conductive traces and a resistive trace having a first end and a second end. The resistive trace is connected to the conductive traces at each of the first end and the second end and forming an electrical connection between the conductive traces and the resistive trace. The heater further comprises a substrate. A first strip is printed on the substrate using a first metal ink and a second strip is printed on the substrate using a second metal ink. The second strip is in contact with the first strip. The first metal ink is different from the second metal ink. The first strip and the second strip form a thermocouple. The thermocouple is operatively attached to the conductive traces. A controller is operatively attached to the thermocouple and controls the temperature of the fuser belt.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
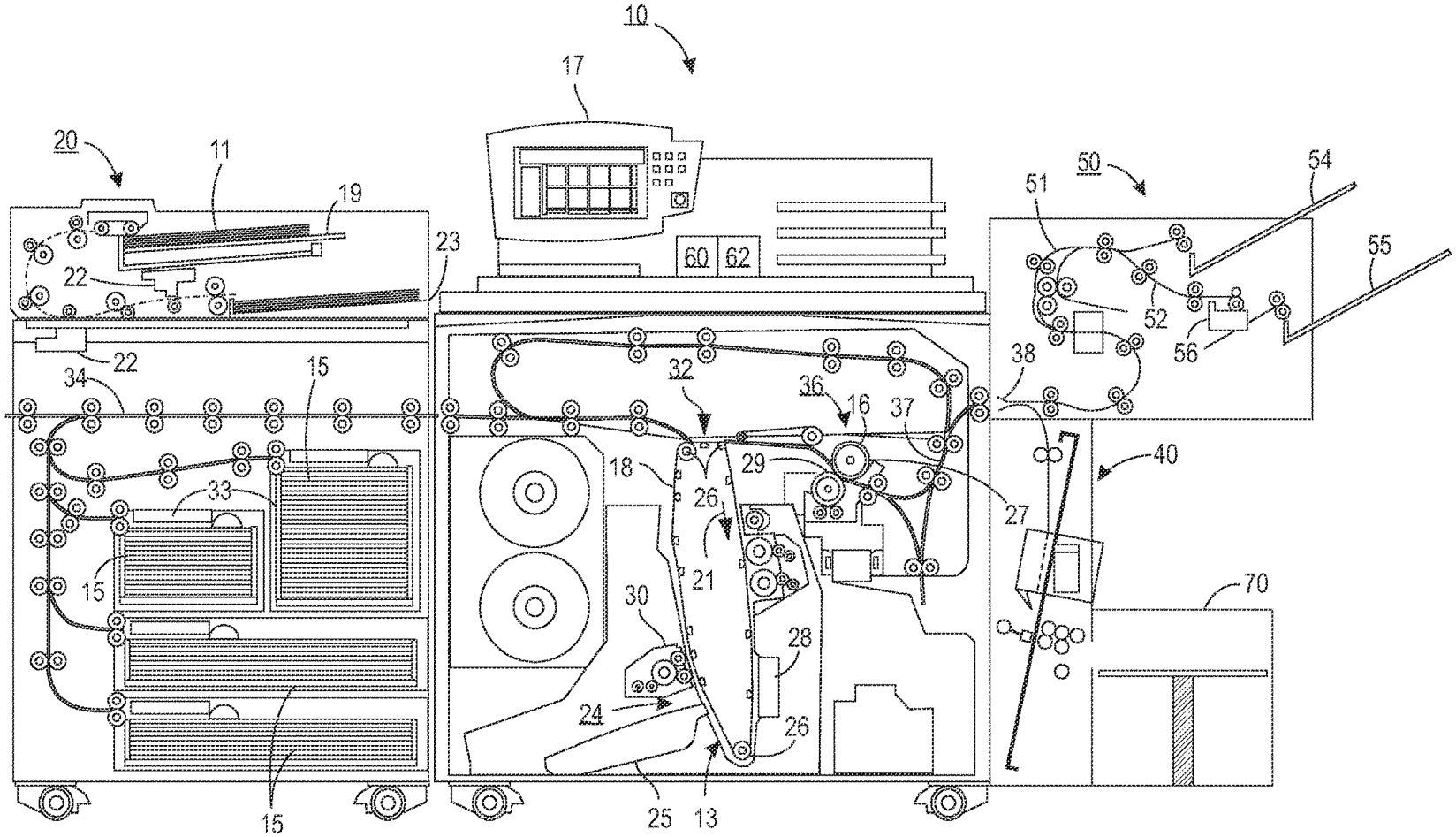
FIG. 1 is a side-view schematic diagram of a printing device according to devices and methods herein.

The disclosure will now be described by reference to a printing apparatus that includes a fusing heater having a thermocouple device embedded in the heater. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

The term 'printer', 'printing device', or 'reproduction apparatus' as used herein broadly encompasses various printers, copiers, or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

Referring to the FIG. 1, a printing device 10 is shown which can be used with devices and methods herein and can comprise, for example, a printer, copier, multi-function machine, multi-function device (MFD), etc. The printing device 10 includes an automatic document feeder 20 (ADF) that can be used to scan (at a scanning station 22) original documents 11 fed from a first tray 19 to a second tray 23. The user may enter the desired printing and finishing instructions through the graphic user interface (GUI) or control panel 17, or use a job ticket, an electronic print job description from a remote source, etc. The GUI or control panel 17 can include at least one processor 60, power supplies, as well as storage devices 62 storing programs of instructions that are readable by the processor 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The photoreceptor belt 18 is mounted on a set of rollers 26. At least one of the rollers 26 is driven to move the photoreceptor belt 18 in the direction indicated by arrow 21 past the various other known electrostatic processing stations, including a charging station 28, imaging station 24 (for a raster scan laser system 25), developing station 30, and transfer station 32.

Thus, the latent image is developed with developing material to form a toner image corresponding to the latent image. More specifically, a sheet of print media 15 is fed from a selected media sheet tray 33 having a supply of paper to a sheet transport 34 for travel to the transfer station 32. There, the toned image is electrostatically transferred to the print media 15, to which it may be permanently fixed by a fusing apparatus 16. The sheet is stripped from the photoreceptor belt 18 and conveyed to a fusing station 36 having fusing apparatus 16 where the toner image is fused to the sheet. The fusing apparatus 16 includes a fuser roll 27 and pressure roll 29. Typically, in this design, the fusing member (fuser roll 27) comprises a very thin tube and is normally referred to as a fuser belt, due to its flexibility. A guide can be applied to the print media 15 to lead it away from the fuser roll 27. After separating from the fuser roll 27, the print media 15 is then transported by a sheet output transport 37 to output trays in a multi-functional finishing station 50.

Printed sheets from the printing device 10 can be accepted at an entry port 38 and directed to multiple paths and output trays for printed sheets, top tray 54 and main tray 55, corresponding to different desired actions, such as stapling, hole-punching and C or Z-folding. The multi-functional finishing station 50 can also optionally include, for example, a modular booklet maker 40 although those ordinarily skilled in the art would understand that the multi-functional finishing station 50 could comprise any functional unit, and that the modular booklet maker 40 is merely shown as one example. The finished booklets are collected in a stacker 70. It is to be understood that various rollers and other devices that contact and handle sheets within the multi-functional finishing station 50 are driven by various motors, solenoids, and other electromechanical devices (not shown), under a control system, such as including the processor 60 of the GUI or control panel 17 or elsewhere, in a manner generally familiar in the art. The processor 60 may comprise a microprocessor.

Thus, the multi-functional finishing station 50 has a top tray 54 and a main tray 55 and a folding and booklet making station that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through staplers 56 and is used for most jobs that require stacking or stapling. The folding destination is used to produce signature booklets, saddle stitched or not, and tri-folded. The finished booklets are collected in a stacker 70. Sheets that are not to be C-folded, Z-folded, or made into booklets or that do not require stapling are forwarded along path 51 to top tray 54. Sheets that require stapling are forwarded along path 52, stapled with staplers 56, and deposited into the main tray 55.

As would be understood by those ordinarily skilled in the art, the printing device 10 shown in FIG. 1 is only one example, and the devices and methods herein are equally applicable to other types of printing devices that may include fewer components or more components. For example, while a limited number of printing engines and paper paths are illustrated in FIG. 1, those ordinarily skilled in the art would understand that many more paper paths and additional printing engines could be included within any printing device used with devices and methods herein.

Currently, a common design of a fusing apparatus 16 includes two rolls, typically called a fuser roll 27 and a pressure roll 29, forming a nip therebetween for the passage of the sheet therethrough. The nip has an entrance side through which the sheet of print media 15 enters. The sheet of print media 15 comes out of the exit side of the nip and is then transported by the sheet output transport 37. Typically, the fuser roll 27 further includes one or more heater elements, which generate heat in response to a current being passed therethrough. The heat from the heater elements passes through the surface of the fuser roll 27, which in turn contacts the side of the sheet having the image to be fused, so that a combination of heat and pressure successfully fuses the image.

In such a printing device 10, the processor 60 in the control panel 17 controls the heater element or elements to take into account the fact that a sheet of a particular size of paper is fed through the nip. As described in further detail below, the processor 60 receives temperature information from a thermocouple device.

The fusing apparatus 16 may include a heater and temperature sensor arranged in a substantially parallel manner along a process direction of the fusing apparatus 16. A controller is included for controlling operation of the heater in response to temperature sensed by the temperature sensor.

Devices and methods herein enable controlling of the temperature of an instant-on fuser using a screen-printed thermocouple built inside the solid heater element. In most of the low energy, belt fusing architectures, the heater element is made from layered traces of silica and conductive inks on a ceramic substrate. The present disclosure describes screen-printing dissimilar metals on (or in) the ceramic substrate to form a thermocouple that replaces the thermistor, which is currently used. (Note, the substrate may be formed of ceramic or other appropriate material, as is known in the art.) The devices and methods described herein provide for a means to implement a thermocouple in the same device as the printer heater elements. Embedded thermocouples may be used to control the temperature of heater elements.

The fuser roll 27 may comprise a fuser belt, as is known in the art. Belt fusers with solid heaters are becoming an increasingly popular design for office printers because of their short warm-up times and low energy usage. The solid heaters for these belt fusers are manufactured by layers of screen-printing that mixes fine silica, resistive ink, and conductive ink. Currently, thermistors placed directly on top of the heater, are used to control the fusing temperature. The thermistors provide accurate temperature measurements that respond quickly, but they take up space and are costly. In view of this, the methods herein form thermocouples directly in the heater element during the screen-printing process. As is understood by those ordinarily skilled in the art, screen-printing of conductive inks on a printed circuit board often uses a screen stencil having a predetermined pattern. More specifically, in such a process a stencil is placed on a printed circuit board, a conductive ink is applied onto the stencil, and then a squeegee is drawn across the stencil so that the conductive ink is squeezed through fine mesh (e.g., silk screen) openings of the stencil. Using screen-printing, strips of two dissimilar metal inks can be printed into the heater element and made to contact, forming a thermocouple, at a location near (e.g., within 1 mm, 0.5 mm, 0.01 mm, 0.001 mm, etc.) the heater trace of interest. Wires of similar metal are then run from leads of each strip of metal ink back to a controller in the printer where the voltage of the thermocouple effect is measured and converted into a temperature.

Figure 2A:
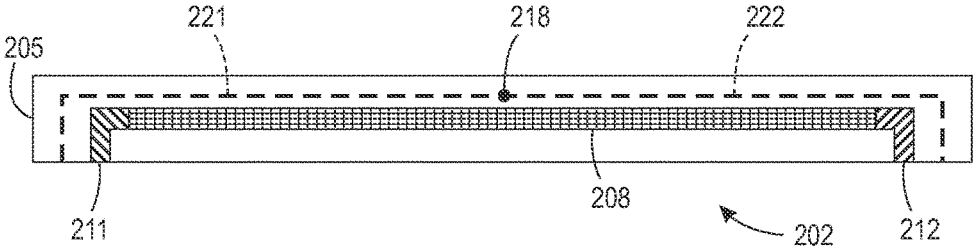
FIG. 2A is a top view illustration of a resistive trace and printed thermocouple in a single plane according to devices and methods herein.

FIG. 2A shows a top view of a heater element, indicated generally as 202, disposed in a substrate 205. The substrate 205 may be incorporated inside the fuser roll 27, fuser belt, or other components of the fusing apparatus 16, as described above. A resistive trace 208 is connected to conductive traces 211, 212 at each end of the resistive trace 208. As is understood by those ordinarily skilled in the art, "traces" are electrical pathways or wires and are commonly formed on printed circuit boards. Therefore, a conductive trace can be any form of conductor, or conductive wire or electrical pathway; and similarly, a resistive trace may be any form of resistor, or restive wire or electrical pathway. While both conductive traces and resistive traces are electrical conductors, conductive traces are often distinguished from resistive traces by how resistive they are; and resistive traces can be, for example 10×, 100×, 1000×, 10,000× etc. more resistive than the conductive traces that supply them with current.

Figure 2B:
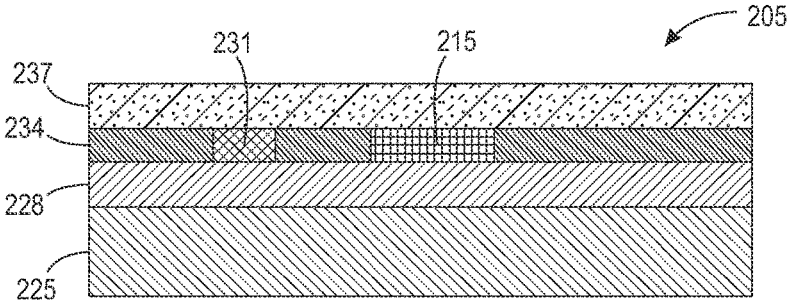
FIG. 2B is a cross-sectional view of the resistive trace and printed thermocouple of FIG. 2A.

According to devices and methods herein, the resistive trace 208 may be formed by any appropriate means, such as screen-printing. For example, resistive ink, such as indicated in FIG. 2B at 215, may be screen-printed onto the substrate 205 to form the resistive trace 208, among other well-known formation processes. The resistive trace 208 generates heat when power is supplied through the conductive traces 211, 212. The heating operation of the heater element 202 quickly reaches its stable operating state, because the resistive trace 208 generates heat in response to the power applied thereto. The heat is generated in the heater element 202 according to the typical $I^2R$ formula, where I is the current flowing in the heater element 202, and R is the resistance of the resistive trace 208. In other words, electrical current flows between, for example, conductive trace 211 and conductive trace 212 generating heat from the resistive trace 208. The heat is evenly distributed along the resistive trace 208 between conductive trace 211 and conductive trace 212. As illustrated in FIG. 2A, the resistive trace 208 is a single resistive trace. It is contemplated that the resistive trace 208 may comprise multiple traces with branches and separate taps.

The heater element 202 includes a thermocouple 218 in the same layer as the resistive trace 208. The thermocouple 218 is formed by the connection of two metal strips 221, 222 formed of dissimilar metal inks. The thermocouple 218 can be created by silkscreen printing two metal inks (or other thermocouple-active materials) onto the substrate 205, among other well-known formation processes. For example, a first metal strip 221 may be silk screened onto (or embedded into) the substrate 205 using a first metal ink. The first metal ink may include a material, such as iron, forming the first metal strip 221. A second metal strip 222 may be silk screened onto (or embedded into) the substrate 205 using a second metal ink. The second metal ink may include a material, which may be a combination of nickel and copper, forming the second metal strip 222. The silk-screening of the first metal strip 221 and the second metal strip 222 onto the same surface is made so as to intersect the first metal strip 221 and the second metal strip 222. Then, by attaching electrical connectors to each metal strip 221, 222 of the silkscreened combination, it is possible to monitor temperature changes by measuring the voltage generated by the printed combination.

It is contemplated that the metal inks may comprise a first powdered metal with a binding agent and a second powdered metal that is different from the first powdered metal and a binding agent. The binding agent for the first powdered metal may be the same or different from the binding agent for the second powdered metal. That is, each metal ink may contain powdered metal, such as iron, nickel, copper, cadmium, aluminum, platinum, rhodium, nickel-chromium, nickel-aluminum, lead, silver, gold, etc., and also combinations or alloys of the same. As is understood by those ordinarily skilled in the art, the dissimilar metals used for a thermocouple can comprise any known metals, so long the junction of the dissimilar metals will produce an electric potential related to temperature. Thermocouples for practical measurement of temperature are junctions of specific alloys that have a predictable and repeatable relationship between temperature and voltage. Different alloys are used for different temperature ranges, and properties such as resistance to corrosion are also useful when choosing the type of dissimilar metals to use in a thermocouple. Common thermocouples include nickel alloy thermocouples, platinum/rhodium alloy thermocouples, tungsten/rhenium alloy thermocouples, chromel-gold/iron alloy thermocouples, noble metal alloy thermocouples, platinum/molybdenum alloy thermocouples, iridium/rhodium alloy thermocouples, pure noble metal thermocouples, etc. While certain metals have been disclosed as non-limiting examples of dissimilar metals to use for the thermocouple 218, as would be known by one of ordinary skill in the art, other appropriate metal combinations can be used, but certain metals are preferred for their predictable output voltages when used as a component of a thermocouple.

The pair of metal strips 221, 222 are placed in electrical communication with a temperature sensor interface circuit of the processor 60, which measures the voltage generated by the thermocouple 218 and indicates the temperature of the heater element 202. The processor 60 receives temperature information from the thermocouple 218 and controls the current flowing in the resistive trace 208, thereby aiding in preventing overheating of the fusing apparatus 16 and the printing system as a whole. The temperature feedback from the thermocouple 218 is then used to control power across the resistive trace 208 and thus the fusing temperature.

Referring to FIG. 2B, which is a cross-sectional view of the resistive trace and printed thermocouple, the substrate 205 may comprise multiple layers. For example, as shown in FIG. 2B, the substrate 205 may include a solid layer 225 having a glass layer 228 disposed on the surface of the solid layer 225. The resistive ink 215 and metal ink 231 may be printed in the same plane of another glass layer 234. Following printing of the resistive ink 215 and metal ink 231, a protective layer 237 may be deposited on the substrate 205. Note: the glass layers listed herein may comprise other materials, such as ceramic, porcelain, silica, and similar insulator materials.

Figure 3A:
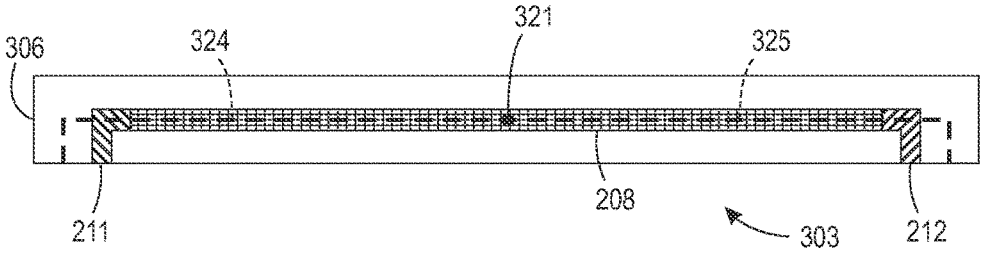
FIG. 3A is a top view illustration of a resistive trace and printed thermocouple in multiple planes according to devices and methods herein.

FIG. 3A illustrates a top view of a heater element, indicated generally as 303, in a multiplane substrate 306. The multiplane substrate 306 may be incorporated in the fuser roll 27 or other components of the fusing apparatus 16, as described above. The resistive trace 208 is connected to conductive traces 211, 212 at each end of the resistive trace 208. According to devices and methods herein, the resistive trace 208 may be formed by any appropriate means, such as screen-printing. As described above, the resistive trace 208 generates heat when power is supplied through the conductive traces 211, 212. The heating operation of the heater element 303 quickly reaches its stable operating state, because the resistive trace 208 generates heat in response to the power applied thereto. The heat is generated in the heater element 303 according to the typical $I^2R$ formula, where I is the current flowing in the heater element 303, and R is the resistance of the resistive trace 208. In other words, electrical current flows between, for example, conductive trace 211 and conductive trace 212 generating heat from the resistive trace 208. The heat is evenly distributed along the resistive trace 208 between conductive trace 211 and conductive trace 212. Again, as illustrated in FIG. 3A, the resistive trace 208 is a single resistive trace. It is contemplated that the resistive trace 208 may comprise multiple traces with branches and separate taps.

In this case, the heater element 303 includes a thermocouple 321 in a different layer, above the resistive trace 208. The thermocouple 321 is formed by the connection of two metal strips 324, 325 formed of dissimilar metal inks. The thermocouple 321 can be created by silkscreen printing two metal inks (or other thermocouple-active materials) onto one layer of the multiplane substrate 306. For example, a first metal strip 324 may be silk screened onto (or embedded into) a layer of the multiplane substrate 306 using a first metal ink. The first metal ink may include a material, such as iron, forming the first metal strip 324. A second metal strip 325 may be silk screened onto (or embedded into) the same layer of the multiplane substrate 306 using a second metal ink. The second metal ink may include a material, which may be a combination of nickel and copper, forming the second metal strip 325. The silk-screening of the first metal strip 324 and the second metal strip 325 onto the same surface is made so as to intersect the first metal strip 324 and the second metal strip 325. Then, by attaching electrical connectors to each metal strip 324, 325 of the silkscreened combination, it is possible to monitor temperature changes by measuring the voltage generated by the printed combination. While iron, nickel, and copper have been disclosed as non-limiting examples of dissimilar metals to use for thermocouple 321, as would be known by one of ordinary skill in the art, other appropriate metal combinations can be used.

The pair of metal strips 324, 325 are placed in electrical communication with a temperature sensor interface circuit of the processor 60, which measures the voltage generated by the thermocouple 321 and determines the temperature of the heater element 303. The processor 60 receives temperature information from the thermocouple 321 and controls the current flowing in the resistive trace 208, thereby aiding in preventing overheating of the fusing apparatus and the xerographic system as a whole. The temperature feedback from the thermocouple 321 is then used to control power across the resistive trace 208 and thus the fusing temperature.

Figure 3B:
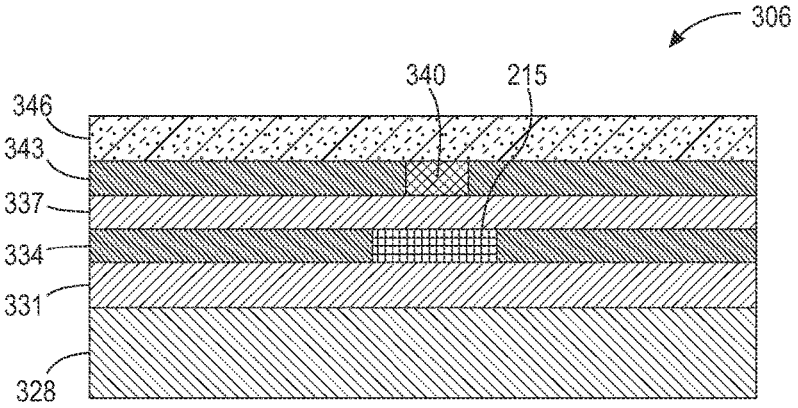
FIG. 3B is a cross-sectional view of the resistive trace and printed thermocouple of FIG. 3A.

Referring to FIG. 3B, which is a cross-sectional view of the resistive trace and printed thermocouple, the multiplane substrate 306 may comprise multiple layers. For example, as shown in FIG. 3B, the multiplane substrate 306 may include a solid layer 328 having a first glass layer 331 disposed on the surface of the solid layer 328. The resistive ink 215 for the resistive trace 208 may be printed in a second glass layer 334 on top of the first glass layer 331. In a multilayer configuration, a third glass layer 337 may be disposed on the surface of the second glass layer 334, covering the resistive ink 215, in order to separate the resistive trace 208 from the thermocouple 321. The metal ink 340 for each of the metal strips 324, 325 for the thermocouple 321 may be printed in a fourth glass layer 343 on top of the third glass layer 337. As described above, the metal strips 324, 325 for the thermocouple 321 are both printed in the same layer. Following printing of the resistive ink 215 and metal ink 320, a protective layer 346 may be deposited on the multiplane substrate 306.

The devices and methods described herein disclose a fuser heater within a printing device with a screen-printed thermocouple in the fuser heater. The heater comprises a substrate and conductive traces attached to the substrate. A resistive trace is attached to the substrate and connected to the conductive traces, forming an electrical connection between the conductive traces and the resistive trace. According to devices and methods herein, a first strip is printed on the substrate using a first metal ink. A second strip is printed on the substrate using a second metal ink. The first metal ink is different from the second metal ink. The second strip is in contact with the first strip. Therefore, the first strip and the second strip form a thermocouple, which is operatively attached to the conductive traces in order to control the temperature of the fuser heater.

According to a machine herein, the machine comprises an imaging station 24 recording an image, a transfer station 32 transferring the image onto a copy sheet, and a fusing apparatus 16. The fusing apparatus 16 includes a fuser roll 27, which may comprise a fuser belt, and a pressure roll 29. The fuser roll 27 and pressure roll 29 form a nip therebetween through which the copy sheet is conveyed, permanently fusing the image onto the copy sheet. The fuser roll 27 includes a heater that heats the fuser roll 27. The heater comprises conductive traces 211, 212 and a resistive trace 208 electrically connected to the conductive traces 211, 212 printed on a substrate. The heater includes a first strip 221 printed on the substrate using a first metal ink and a second strip 222 printed on the substrate using a second metal ink. The first metal ink is different from the second metal ink. The first strip 221 is in contact with the second strip 222 forming a thermocouple 218. A controller, which may include a processor 60, controls the temperature of the fuser roll 27. The conductive traces 211, 212 are operatively attached to the controller. The thermocouple 218 is operatively attached to the controller.

According to a printing device 10, an imaging station 24 records an image. A transfer station 32 transfers the image onto a copy sheet. The printing device 10 includes a fusing apparatus 16 comprising a fuser roll 27, which may comprise a fuser belt, and pressure roll 29. The fuser roll 27 and pressure roll 29 form a nip therebetween through which the copy sheet is conveyed, permanently fusing the image onto the copy sheet. The fuser roll 27 includes a heater that heats the fuser roll 27. The heater comprises conductive traces 211, 212 and a resistive trace 208 printed on a substrate. The resistive trace 208 is connected to the conductive traces 211, 212 at each of a first end and a second end and forming an electrical connection between the conductive traces 211, 212 and the resistive trace 208. The heater further comprises a first strip 221 printed on the substrate using a first metal ink and a second strip 222 printed on the substrate using a second metal ink. The second strip 222 is in contact with the first strip 221. The first metal ink is different from the second metal ink. The first strip 221 and the second strip 222 form a thermocouple 218. The thermocouple 218 is operatively attached to the conductive traces 211, 212.

While the above examples illustrate a single thermocouple printed either in the same layer as the resistive trace or in a different layer from the resistive trace, multiple thermocouples can be printed on the same device, with various thermocouples being printed in the same plane, in different planes, or in combinations of the same and different planes.

Embedding thermocouples in the heater element offers a substantial number of benefits. The cost of printing the thermocouples in heater elements is substantially reduced, as the increased cycle time for each element could be as little as two screen passes. Removing the thermistors adds the benefit of saving space inside the cramped belt interior and making the assembly process of the fuser simpler with fewer parts.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

As mentioned above, the terms 'printer' or 'printing device' as used herein encompasses any apparatus, such as a digital copier, bookmaking machine, facsimile machine, multi-function machine, etc., that performs a print outputting function for any purpose. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises," "comprising," and/or "including," when used in this specification, specify the presence of stated features, integers, steps, operations, elements, and/or components, but do not preclude the presence or addition of one or more other features, integers, steps, operations, elements, components, and/or groups thereof. Further, the terms 'automated' or 'automatically' mean that once a process is started (by a machine or a user), one or more machines perform the process without further input from any user.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

It will be appreciated that the above-disclosed and other features and functions, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the systems and methods herein should not be implied or imported from any above example as limitations to any particular order, number, position, size, shape, angle, color, temperature, or material.

What is claimed is:

1. A printing machine, comprising:

an imaging apparatus recording an image;

a transfer device transferring said image onto a sheet;

a fuser permanently fusing said image onto said sheet; and a controller connected to said fuser, said fuser including an internal heater and an internal temperature sensor printed on different layers of a multi-layer substrate, said internal heater comprising:

said multi-layer substrate;

a conductive trace on said multi-layer substrate; and a resistive trace on a first glass layer of said multi-layer substrate and electrically connected to said conductive trace, said internal temperature sensor comprising:

a first metal ink strip on a second glass layer of said multi-layer substrate that is different from said first glass layer;

a second metal ink strip on said second glass layer of said multi-layer substrate; and a glass insulator between said first glass layer and said second glass layer of said multi-layer substrate, separating said resistive trace from said first metal ink strip and said second metal ink strip, said first metal ink strip being a different metal from said second metal ink strip, said first metal ink strip being in contact with said second metal ink strip and forming a thermocouple, said conductive trace being electrically attached to said controller, said thermocouple being electrically attached to said controller, said resistive trace and said thermocouple both being inside said internal heater, said resistive trace comprising an element producing heat inside said internal heater, said thermocouple detecting a temperature inside said internal heater, and said controller controlling operation of said internal heater in response to said temperature sensed by said thermocouple.

2. The printing machine according to claim 1, said first metal ink strip and said second metal ink strip being printed on said multi-layer substrate using silk-screen printing.

3. The printing machine according to claim 1, said resistive trace being printed on said multi-layer substrate using silk-screen printing.

4. The printing machine according to claim 1, further comprising a plurality of thermocouples printed on said multi-layer substrate, said plurality of thermocouples being operatively attached to said controller.

5. The printing machine according to claim 1, said fuser comprising a fuser belt and a pressure roll, said fuser belt and pressure roll forming a nip there between through which said sheet is conveyed, said fuser belt being located adjacent said pressure roll, and said fuser belt and said pressure roll forming a nip therebetween, said nip having an entrance side and an exit side, said resistive trace being positioned adjacent said nip.

6. A printer, comprising:

an imaging apparatus recording an image;

a transfer device transferring said image onto a sheet;

a fuser permanently fusing said image onto said sheet; and a controller connected to said fuser, said fuser including an internal heater comprising conductive traces and a resistive trace having a first end and a second end, said resistive trace being connected to said conductive traces at each of said first end and said second end, and forming an electrical connection between said conductive traces and said resistive trace, said internal heater comprising a multi-layer substrate, said resistive trace being on a first glass layer of said multi-layer substrate, said fuser including an internal temperature sensor formed on a second glass layer of said multi-layer substrate, said internal temperature sensor comprising:

a first metal ink strip on said multi-layer substrate;

a second metal ink strip on said multi-layer substrate; and a glass insulator between said first glass layer and said second glass layer of said multi-layer substrate, separating said resistive trace from said first metal ink strip and said second metal ink strip, said first metal ink strip being a different metal from said second metal ink strip, said first metal ink strip and said second metal ink strip forming a thermocouple, said first metal ink strip and said second metal ink strip being parallel to said resistive trace, said thermocouple being electrically attached to said conductive traces, said conductive traces being electrically attached to said controller, said thermocouple being electrically attached to said controller, said resistive trace and said thermocouple both being inside said internal heater, said resistive trace comprising an element producing heat inside said internal heater, said thermocouple detecting a temperature inside said internal heater, and said controller controlling operation of said internal heater in response to said temperature sensed by said thermocouple.

7. The printer according to claim 6, said first metal ink strip and said second metal ink strip being printed on said multi-layer substrate using silk-screen printing.

8. The printer according to claim 6, said resistive trace being printed on said multi-layer substrate using silk-screen printing.

9. A printer fuser comprising:

a sheet feeding nip between opposing pressure surfaces, a heater positioned to heat one of said pressure surfaces, said heater comprises an internal heating element and an internal temperature sensor on different glass layers of a multi-layer structure, said internal heating element comprises a resistor on a first glass layer in said multi-layer structure, and said internal temperature sensor comprises a thermocouple existing at an intersection of a first-type of metal strip and a different second-type of metal strip on a second glass layer in said multi-layer structure, said printer fuser further comprising a glass insulator between said first glass layer and said second glass layer, separating said resistor from said first-type metal ink strip and said second-type metal ink strip.

10. The printer fuser according to claim 9, further comprising a controller electrically connected to said internal heating element and said internal temperature sensor.

11. The printer fuser according to claim 10, said controller controlling said internal heating element to maintain said heater within a temperature range detected by said internal temperature sensor.

12. The printer fuser according to claim 9, said internal temperature sensor comprises a plurality of thermocouples in said multi-layer structure.

13. The printer fuser according to claim 9, said one of said pressure surfaces comprises a fuser belt.

14. The printer fuser according to claim 9, said first-type of metal strip and said second-type of metal strip have physical characteristics corresponding to screen printing.

* * * * *